United States Patent [19]

Seitz

[11] 4,391,399

[45] Jul. 5, 1983

[54] MANUALLY ASSEMBLABLE SHEET-FEED TRACTOR

[75] Inventor: Alan F. Seitz, New Hartford, Conn.

[73] Assignee: Data Motion, Incorporated, Torrington, Conn.

[21] Appl. No.: 305,492

[22] Filed: Sep. 25, 1981

[51] Int. Cl.[3] ..... B65H 17/38

[52] U.S. Cl. ..... 226/74

[58] Field of Search ..... 226/74, 75, 76, 79, 226/170–173, 190; 403/345, 350

[56] References Cited

U.S. PATENT DOCUMENTS

| | | | |
|---|---|---|---|
| 3,930,601 | 1/1976 | Masuda | 226/74 |
| 4,129,239 | 12/1978 | Hubbard | 226/75 |
| 4,199,091 | 4/1980 | Hubbard | 226/74 |
| 4,214,691 | 7/1980 | van Namen | 226/74 |
| 4,226,353 | 10/1980 | Blaskovic et al. | 226/74 |
| 4,315,585 | 2/1982 | Seitz | 226/74 |

*Primary Examiner*—Stanley N. Gilreath

[57] ABSTRACT

A sheet-feed tractor for printers employs two principal frame members, one of which is integrally molded with a part of the tractor clamp. A second clamp part is assembled onto the first clamp part, and the two clamp parts together hold the frame members in assembly. A snap-fit cover prevents rotation of the second clamp part to a position in which it can be removed from the first clamp part, so the tractor is held in assembly so long as the cover is in place. Disassembly is easily achieved by removing the cover, pivoting the second clamp part to a position in which it can be removed from the first clamp part, and then easily removing the remaining parts of the tractor.

26 Claims, 7 Drawing Figures

MANUALLY ASSEMBLABLE SHEET-FEED TRACTOR

BACKGROUND OF THE INVENTION

The present invention is directed to sheet-feed tractors of the type employed in connection with printers used with computers, word processors, and the like.

The explosion in the use of data and word processing in recent years has resulted in a volume of sales that has caused significant cost competition not only in the end products but also in the components employed. Among these components are the sheet-feed tractors, which are used to drive perforated paper on which automated typing takes place.

An example of a sheet-feed tractor that is so arranged as to permit production at relatively low expense is one produced by Data Motion of Torrington, Connecticut, and described in U.S. patent application Ser. No. 128,590 of Alan F. Seitz, now U.S. Pat. No. 4,315,585, for a Sheet-Feed Tractor with Eccentric Clamping Device. The tractor is made almost exclusively of molded plastic parts and includes two generally parallel frame halves between which is mounted a molded sprocket. A molded drive belt is trained about the sprocket, and tabs on a clamp part are held between the frame parts to hold the molded clamp on the tractor. With the exception of pins used for mounting a molded cover and a spring used in holding it down, this tractor is made entirely of molded plastic, and parts are snap fit or friction fit together.

This type of tractor has advantages of low cost and reliability, but attempts have been made to further reduce the cost associated with tractor manufacture. One attempt is evidenced by U.S. Pat. No. 4,199,091 to Hubbard, which discloses a tractor is which one frame half has flexible rods with latches for holding the other frame half in assembly. The intent is that the tractor be easily disassembled by manual deflection of the rods. Whatever the benefits of this arrangement may be, the clamp parts must be snap fit in such a way as to present considerable resistance to disassembly.

The object of the present invention is therefore a tractor that can be readily assembled and disassembled without the use of tools or excessive exertion. It is a related object of the present invention to achieve this in a tractor that permits variation in the spacing between the support and drive shafts during operation and yet employs a minimum number of parts.

SUMMARY OF THE INVENTION

Certain of the foregoing and related objects are achieved in a sheet-feed tractor adapted to be slidably mounted on spaced apart and substantially parallel extending elongated support and drive shafts. The tractor includes first and second frame members, a drive shaft, an endless belt, and clamp means. The first frame member has a support-shaft opening in it, and the second frame member is assembled on the first frame member to form a tractor frame with it. The drive sprocket is mounted on the tractor frame for rotation about its axis. It has an aperture through it that is adapted to receive the drive shaft for sliding of the sprocket along the shaft and for driving by it upon rotation of the drive shaft about its longitudinal axis. The endless belt is disposed about the tractor frame in engagement with the drive sprocket to be driven by it upon driving movement of the sprocket by the drive shaft. The drive belt includes sheet engagement teeth adapted to engage in the perforations of sheet material that is perforated against its side margins. The teeth engage the sheet material in such a way as to advance it upon driving of the belt by the sprocket.

The clamp means has an aperture through it adapted to receive the support shaft for clamping the support shaft received in the aperture. The clamp means includes a first clamp part on the second frame member that extends through the support-shaft opening of the first frame member to the side of the first frame member opposite that on which the second frame member is disposed. The clamp means includes a second clamp part disengageably mounted on the first clamp part and movable relative to it to clamp a support shaft received in the aperture in the clamp means. The second clamp part bears against the side of the first frame member opposite the second frame member to retain the first and second frame members in assembly. The frame members are held in assembly by the clamp parts, and removal of the second clamp part from the first clamp part permits ready disassembly of the frame members from each other.

It is preferable for the second clamp part to be rotatable on the first clamp part and to be removable from the first clamp part in at least one rotational position and to be positively retained on the first clamp part in at least one other rotational position.

In the illustrated embodiment, the first clamp part has a generally cylindrical exterior surface, and the second clamp part includes a ring portion receiving the generally cylindrical exterior surface of the first clamp part within it. Either the interior surface of the ring portion or the generally cylindrical exterior surface of the first clamp part provides a radially extending tab while the other provides an engagement surface and an axial slot. The engagement surface engages the tab throughout a first range of rotational positions of the second clamp part so as to prevent axial removal of the second clamp part from the first clamp part. The slot is aligned with the tab in at least one second rotational position of the second clamp part so as to permit axial removal of the second clamp part from the first clamp part and thereby permit disassembly of the frame members.

A tractor following the teachings of the present invention may conveniently include a cover member disengageably and pivotably mounted on the tractor frame for pivoting between an open position and a closed position. The cover would have a paper-engagement surface adapted for maintaining paper in engagement with the belt when the cover is in the closed position. The cover would also have a stop surface for preventing rotation of the second clamp part into its second rotational position. The cover thereby prevents disassembly of the tractor while the cover is mounted on the frame, and removal of the cover permits the second clamp part to assume the second rotational position and thus permit axial removal of the second clamp part and disassembly of the frame members. Preferably, the cover is snap fit on the frame. In the illustrated embodiment, the second clamp part includes a radially extending lever portion, and the stop surface on the cover engages the lever portion.

Certain of the objects of the present invention are also achieved in a sheet-feed tractor adapted to be slidably mounted on spaced apart and substantially parallel extending elongated support and drive shafts. Such a sheet-feed tractor includes first and second frame members, a drive sprocket, an endless belt, and clamp means. The drive sprocket is rotatably mounted on the first frame member for rotation about the axis of the drive sprocket. It has an aperture through it that is adapted to receive the drive shaft for sliding of the sprocket along the drive shaft and for driving of the sprocket by the drive shaft when the drive shaft rotates about its longitudinal axis. The endless belt is disposed about the first frame member in engagement with the drive sprocket so as to be driven by it upon driving movement of the drive sprocket by the drive shaft. The drive belt includes sheet engagement teeth adapted to engage in the perforations of sheet material perforated adjacent its side margins for advancement of the sheet material upon driving of the drive belt by the sprocket. The second frame member is slidably mounted on the first frame member for sliding in a direction perpendicular to the rotational axis of the sprocket. The sprocket and the endless belt are disposed between the first and second frame members.

The clamp means is disposed on the second frame member for sliding movement with the second frame member relative to the first frame member. The clamp means has an aperture through it adapted to receive the support shaft in it and to clamp it in fixed position relative to the second frame member. Variation in the spacing between the drive and support shafts while the support shaft is clamped to the second frame member is thereby accommodated by sliding of the second frame member relative to the first frame member.

The clamp means preferably includes at least a first clamp part and a second clamp part mounted on the first clamp part for movement relative to the first clamp part to clamp the support shaft in it.

Certain of the objects of the invention are achieved in a sheet-feed tractor of the type described above in which the second clamp part also includes an extension portion that extends from the ring portion to provide a second engagement surface adjacent an edge of the extension portion remote from the ring portion and spaced from the first engagement surface in a direction generally perpendicular to the axis of the support-shaft opening. A post is provided on the second frame member, and the first frame member has a post aperture in it aligned with the post. The post extends from the second frame member through the post aperture in the first frame member to the side of the first frame member opposite that on which the second frame member is disposed. The post is positioned radially beyond the remote edge of the extension portion. The post includes a second tab extending radially inward of the remote edge of the extension portion to engage the second engagement surface throughout the first range of rotational positions of the second clamp part. This causes the extension portion to bear against the side of the first frame member opposite the second frame member so as to retain the first and second frame members in assembly. Engagement of the second tab and second engagement surface also prevents axial removal of the second clamp part from the first clamp part. In the second rotational position of the second clamp part, the second engagement surface clears the second tab to permit axial removal of the second clamp part from the first clamp part. Removal of the second clamp part from the first clamp part permits ready disassembly of the frame members from each other.

BRIEF DESCRIPTION OF THE DRAWINGS

These and further features and advantages of the present invention are described in connection with the accompanying drawings, in which.

DETAILED DESCRIPTION OF THE PREFERRED EMBODIMENT

Figure 1:
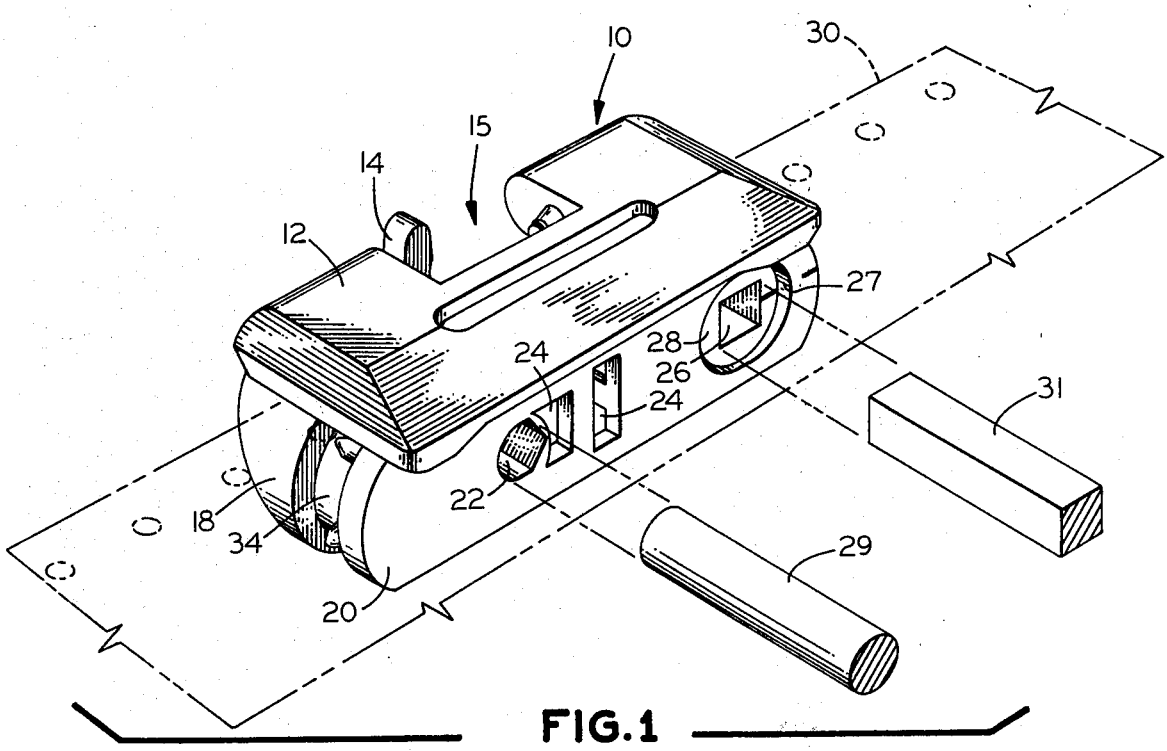
FIG. 1 is a perspective view of a tractor employing the teachings of the present invention.
Figure 2:
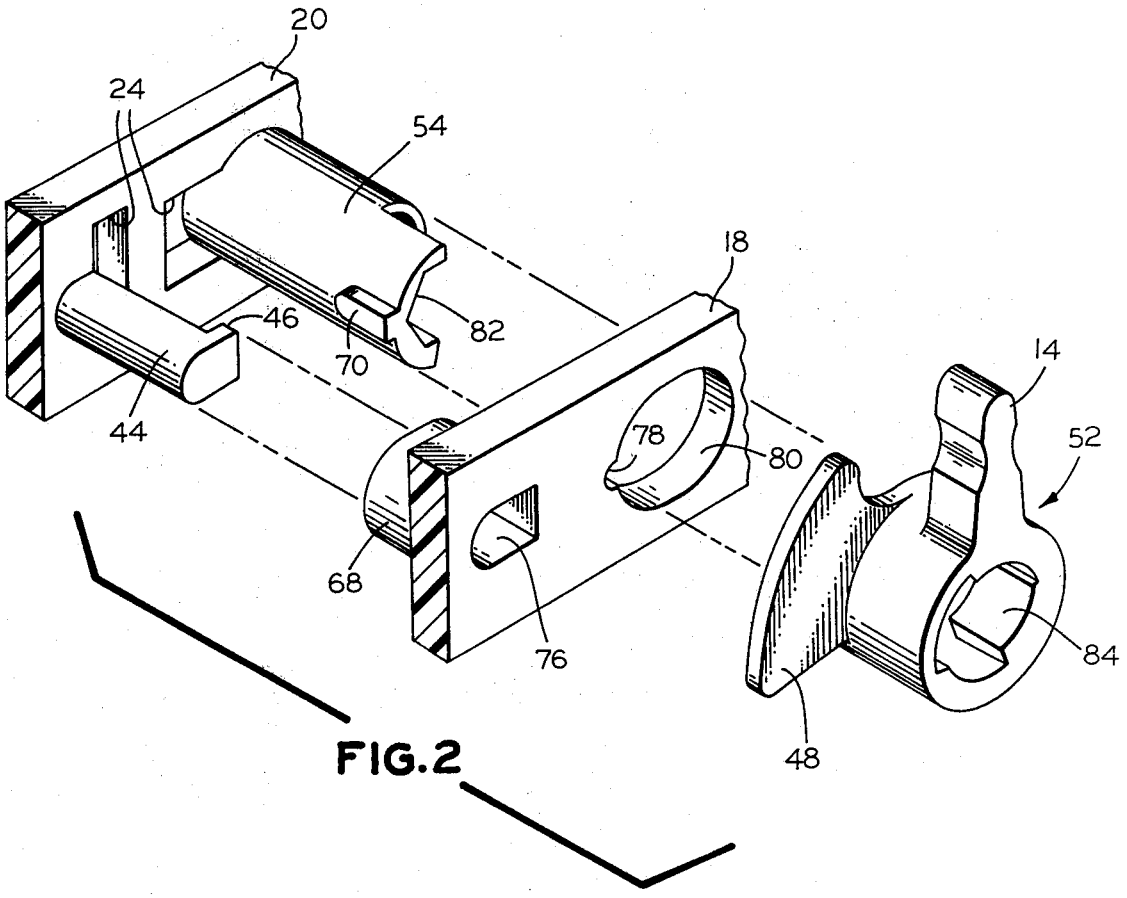
FIG. 2 is an exploded view of a portion of the tractor in the vicinity of the clamp.

The drawings illustrate a sheet-feed tractor 10 that can be assembled totally by hand without the use of tools and without the use of force at a level that would excessively tire the hands of assembly personnel. The two main frame members 18 and 20 of FIG. 1 are shown in FIG. 2 to be held together only by the clamp, which includes a first part 54 that is integrally molded with frame part 20. The clamp also includes a second part 52 that fits over first clamp part 54 and holds the frame parts together. The frame parts are held together only by the clamp parts; no friction fit between the two is required. A hole 80 in the first frame member 18 is elongated to permit frame parts 18 and 20 to move longitudinally with respect to each other, and an aperture 27 (FIG. 1) is elongated for the same purpose.

Figure 3:
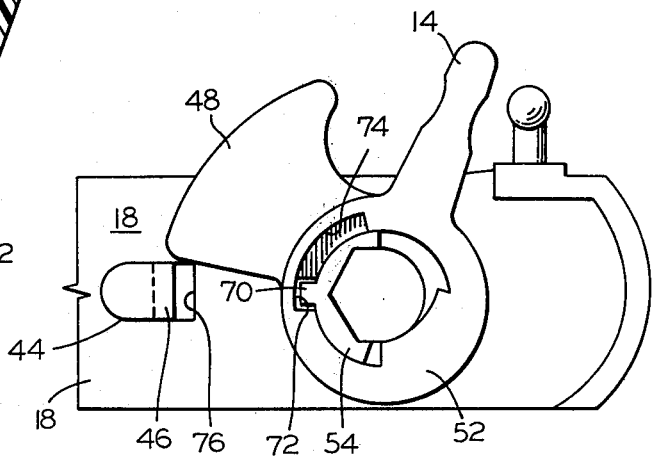
FIG. 3 is a simplified outside elevation showing the tractor with the cover removed and the levered portion of the clamp in position for axial removal.

The several parts shown in FIG. 2 are assembled with clamp part 52 in the rotational orientation shown in FIG. 3. When clamp part 52 is in position on clamp part 54, it is then rotated to the orientation shown in FIG. 4, in which axial removal is prevented. A cover 12 is then snap fit on to the frame, as is suggested in FIG. 5, to prevent clamp part 52 from being rotated to the orientation of FIG. 3, so disassembly is prevented so long as the cover remains in place.

A more detailed perusal of FIG. 1 reveals that it includes two elongated and generally parallel frame members 18 and 20. At one end is provided a sprocket 28 that is journaled in frame member 18 and held in place on frame member 18 by frame member 20. Part of sprocket 28 protrudes through an opening 27 in frame part 20. Aperture 27 is slightly elongated to accommodate longitudinal motion of frame member 18—and thus of sprocket 28—with respect to frame part 20. Also located between frame members 18 and 20 is a drive belt 34, which is engaged by sprocket 28 and retained in position by the ends of frame members 18 and 20.

An irregularly shaped aperture 22 is provided in frame member 20. This aperture is provided for reception of a support shaft 29, on which tractor 10 is clamped by a clamping means described in more detail below but evidenced in FIG. 1 by lever 14. A second shaft, drive shaft 31, has a square cross section, which fits the similar shape of the opening 26 in sprocket 28. Tractor 10 can slide along both shafts 29 and 31 when it is initially set in place, but pivoting of lever 14 causes support shaft 29 to be clamped in axial position on frame member 20. Thus, tractor 10 can be adjusted in position along shafts 29 and 31 with respect to a complementary tractor, not shown, at the other ends of the shafts. When the proper axial position is achieved, it is maintained by the clamping action that results from pivoting of lever 14.

Further apertures 24 are shown in FIG. 1. They have no operational function but are merely included for molding purposes.

When the tractor has been fitted onto shafts 29 and 31 and has been locked into place by pivoting of lever 14, perforated paper, suggested by phantom 30, is positioned so that its perforations register with the teeth 32 (FIG. 6) of drive belt 34. Cover 12 is then pivoted into the position shown in FIG. 1 so as to hold paper 30 in place on belt 34. When the paper is to be advanced, drive shaft 31 is rotated, rotating sprocket 28 to advance belt 34 and thus paper 30.

It is of course important that frame parts 18 and 20 and the parts of the clamp do not become disassembled, such as by accident, during operation. Accordingly, it has been commonplace in the art to provide some positive fastening means, such as a screw, to hold the two frame parts together. Alternately, these frame parts have been friction fit, the frictional force being great enough so that there is virtually no likelihood that the two frame parts would come apart. It has also been the practice to so arrange the clamp parts so that they can only be disassembled with a level of difficulty that would essentially preclude accidental disassembly. Unfortunately, such provisions also make it necessary that tools or fixtures of some type be used in assembly of the parts.

FIG. 2 illustrates the arrangement of the illustrated tractor that permits assembly with no tools or excessive force yet prevents accidental disassembly of the tractor.

A generally cylindrical clamp part 54 and a post 44 are disposed on frame member 20, and both extend perpendicularly to the principal plane of frame member 20. In the illustrated embodiment, they are integrally molded in one piece with frame member 20 to reduce the part count, but this feature, of course, is not essential. Clamp part 54 provides in its interior a clamping surface 82 of the type disclosed in U.S. patent application Ser. No. 128,590 of Alan F. Seitz, now U.S. Pat. No. 4,315,585, for a Sheet-Feed Tractor with Eccentric Clamping Device. The operation of this type of clamp is disclosed in detail in the Seitz application, which is hereby incorporated by reference.

Also included on clamp part 54 is a tab 70 that extends radially outward from the generally cylindrical outer surface of clamp part 54 and is elongated in the axial direction. It is used to hold second clamp part 52 on first clamp part 54, as will be described in greater detail below. For the same purpose, a second tab 46 is provided at the end of post 44. Its function will also be described in greater detail below.

Frame member 18 is provided with apertures 76 and 80, aperture 76 including a slot 78 for accommodating tab 70 of clamp part 54. Aperture 80 is somewhat oblong in the direction longitudinal of frame member 18 so that it can accommodate relative longitudinal motion between frame parts 18 and 20. Aperture 76 is also sized to accommodate such motion. A spacer 68 is integrally molded with frame part 18, and aperture 76 extends through it so that post 44 can be received in it and extend to the side of frame member 18 opposite frame member 20.

A second clamp part 52 includes an interior clamping surface 84 of the type generally described in the Seitz application mentioned above. Clamp part 52 has a generally ring-shaped portion from which a lever portion 14 extends radially outward. In addition to these portions, there is a thin plate-like extension or wing portion 48 that is provided as an integrally molded portion of clamp part 52.

To assemble the tractor, the sprocket and belt are first assembled onto frame member 18. (Belt 34 is trained about sprocket 28 and an idler surface 60 of frame member 18 shown in FIG. 6.) Frame member 20 is then assembled onto frame member 18 in such a fashion that clamp part 54 and post 44 extend through apertures 80 and 76, respectively, to reach to the side of frame member 18 opposite frame member 20. Clamp part 52 is then assembled onto clamp part 54 in the orientation shown in FIG. 3. FIG. 3 reveals that a slot 72 extends axially along a portion of the interior surface of clamp part 52, and, in the orientation of clamp part 52 shown in FIG. 3, it registers with tab 70 of clamp part 54. Also in the orientation illustrated in FIG. 3, wing portion 48 clears tab 46 on post 44, so clamp part 52 can be fit over clamp part 54.

Figure 4:
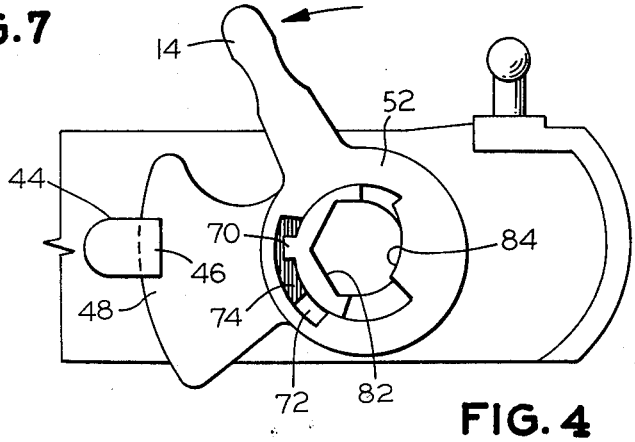
FIG. 4 is a view similar to FIG. 3 with the levered clamp part pivoted to a position in which axial removal is prevented.

Once clamp part 52 has been assembled onto clamp part 54, it can then be pivoted to the position shown in FIG. 4. In the position shown in FIG. 4, an engagement surface 74 on clamp part 52 engages tab 70, so it interferes with the axial motion of clamp part 52 with respect to clamp part 54, and it causes the ring portion of clamp part 52 to bear against frame member 18. The orientation of clamp part 52 shown in FIG. 4 also results in engagement of tab 46 by an engagement surface of wing portion 48 adjacent its outer edge. Axial removal of clamp part 52 from clamp part 54 is also prevented by this engagement, and the wing portion is thereby caused to bear against frame portion 18. Consequently, removal of clamp part 52 from clamp part 54 is positively prevented in all orientations of clamp part 52 other than that shown in FIG. 3. Unless clamp part 52 is in the orientation of FIG. 3, therefore, disassembly is positively prevented although, as can be appreciated in light of the foregoing discussion, assembly can be accomplished in simple manual operations requiring no tools or excessive force.

As is disclosed and broadly claimed in the copending application of Karl G. Seitz, Ser. No. 304,858, filed Sept. 23, 1981 for a Manually Assemblable and Disassemblable Sheet-Feed Tractor Employing Improved Clamp Assembly, two sets of tabs and engagement surfaces are employed that are spaced apart from each other, so frame members 18 and 20 are held together at their ends more firmly than they would be if a single tab and a single engagement surface were used. This is desirable because it is the end portions of the frame members that hold the sprocket and belt in place. According to the present invention, post 44 is disposed radially outward of wing portion 48, so no aperture in wing portion 48 is required, and a maximum spacing between tabs 46 and 56 results.

Figure 6:
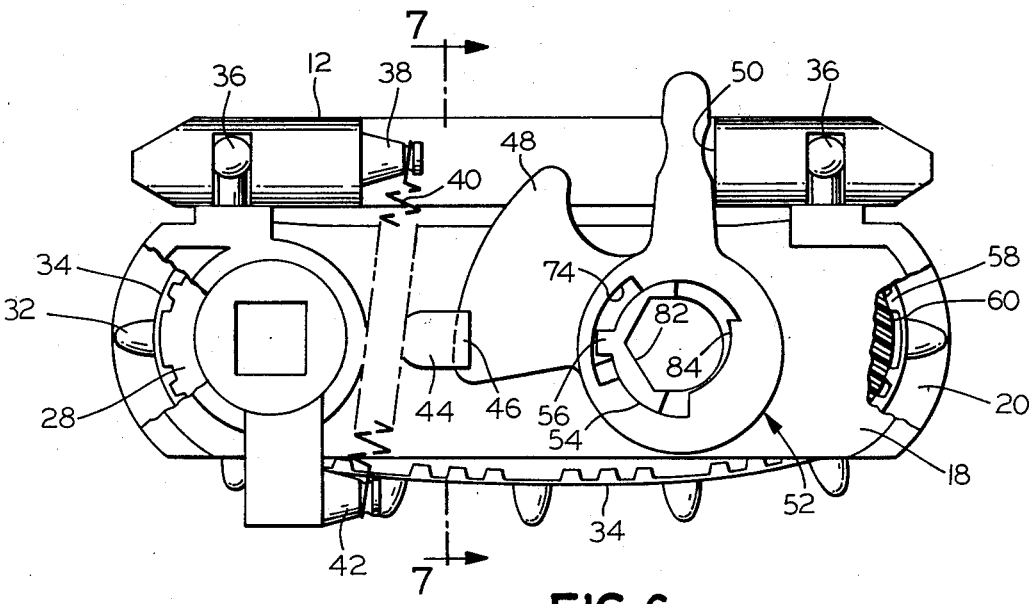
FIG. 6 is an outside elevational view of the tractor with parts broken away to reveal the sprocket and the idler surface.
Figure 5:
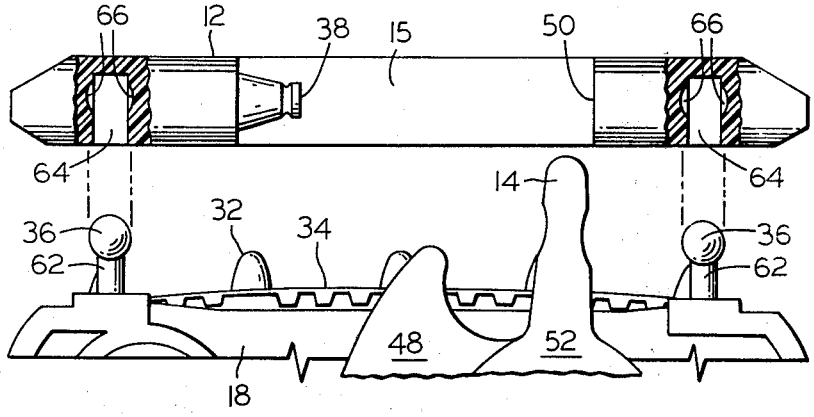
FIG. 5 is an exploded elevational view of the upper portion of the tractor with parts of the cover broken away.

The final steps in the assembly of the tractor are illustrated in FIGS. 5 and 6, which show the assembly of the cover 12 onto the tractor frame and the attachment of the cover spring 40. A rectangular opening 15 in cover 12 accommodates lever 14. Projecting from each end of the upper surface of frame member 18 are posts 62, which are provided at their upper ends with spherical beads 36. The beads are received in recesses 64 in cover 12 that include seating surfaces 66 that mate with beads 36 so that the cover may be snapped into place on the tractor frame. Although the cover is snap fit into place, the force required for its assembly is relatively low, so it can be assembled on a repetitive basis without tools or fixtures.

As FIG. 6 shows, a mounting post 38 is provided on cover 12, and a similar mounting post 42 is provided on frame member 18. Mounting post 38 is located so that spring 40 operates in an over-center manner; the cover, which is pivotably mounted, has two stable positions, one closed and one open. These two stable positions are shown in FIG. 7, the open position being shown in solid and the closed position being shown in phantom.

Figure 7:
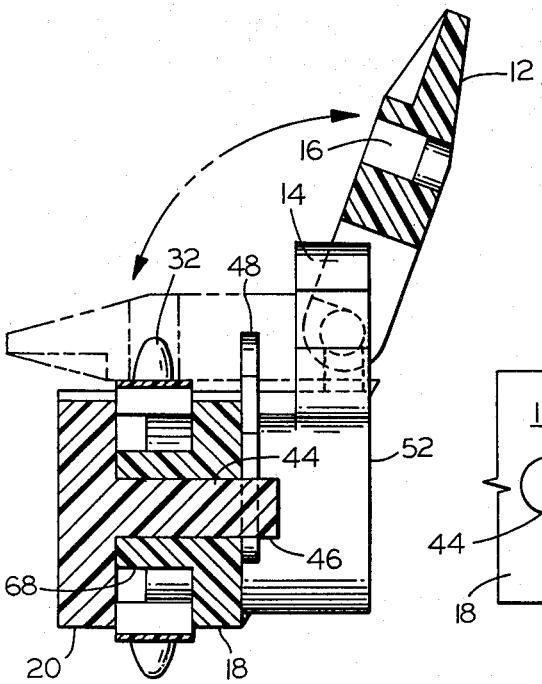
FIG. 7 is a cross-sectional view taken at line 7—7 of FIG. 6.

FIGS. 6 and 7 illustrate the assembled tractor. As FIG. 6 shows, a stop surface 50 is provided on cover 12 that prevents pivoting of clamp part 52 to the orientation shown in FIG. 3. Accordingly, clamp part 52 cannot be removed so long as cover 12 is assembled on the frame.

The operation of the tractor can be understood by reference to FIG. 6. As was mentioned above, sprocket 28 is mounted so as to be rotatable about an axis fixed with respect to frame member 18. Sprocket 28 engages belt 34. Provided toward the right end of frame part 18, as viewed in FIG. 6, is a semi-cylindrical idler surface 60. Belt 34 is trained about sprocket 28 and idler surface 60, both of which are fixed in longitudinal position with respect to frame part 18. Thus, the positions of the belt 34 and sprocket 28, and thus of drive shaft 31, are determined by frame member 18. In contrast, clamp part 54 is integrally molded with frame member 20, so its position is determined by frame member 20. Clamp part 52, being mounted on clamp part 54, also has its position determined by frame member 20, so support shaft 31, which is clamped as described in the above-mentioned application of Alan F. Seitz, has its position determined by frame member 20, too. As was observed in connection with FIG. 2, some longitudinal motion of frame member 20 with respect to frame member 18 is permitted, although the clamp prevents motion axial of the shafts. Therefore, variations in the spacing between the drive and support shafts caused, for instance, by bent shafts, can be accommodated by the relative longitudinal motion between the two frame members 18 and 20.

From the foregoing description, it can be appreciated that a tractor assembled according to the teachings of the instant specification has numerous advantages. One of the frame members and one of the clamp parts can be molded as a single unitary part, thus helping to minimize the parts count. This is achieved while maintaining the ability of the tractor to accommodate variations in the spacing between the support and drive shafts. Furthermore, the parts are positively held in place, yet assembly can be achieved without the use of tools or excessive force. Finally, the tractor can be disassembled by mere removal of the cover and subsequent axial removal of one clamp part from the other, which allows the remaining parts to be freely disassembled. A tractor built according to the teachings of the present invention can thus be produced easily and at low cost.

Having thus described the invention, I claim:

1. A sheet-feed tractor adapted to be slidably mounted on spaced apart and substantially parallel extending elongated support and drive shafts comprising:

a. a first frame member having a support-shaft opening therein;

b. a second frame member assembled on said first frame member to form a tractor frame therewith;

c. a drive sprocket mounted on said tractor frame for rotation about the axis of said drive sprocket and having an aperture therethrough adapted to receive the drive shaft for sliding therealong and for driving thereby upon rotation of the drive shaft about its longitudinal axis;

d. an endless belt disposed about said tractor frame in engagement with said drive sprocket to be driven thereby upon driving movement of said sprocket by the drive shaft, said drive belt including sheet engagement teeth adapted to engage in the perforations of sheet material perforated against the side margins thereof for advancement thereof upon driving of said belt by said sprocket;

e. clamp means, having an aperture therethrough adapted to receive the support shaft therein, for clamping the support shaft received therein, said clamp means including a first clamp part on said second frame member and extending through said support-shaft opening in said first frame member to the side of said first frame member opposite that on which said second frame member is disposed, said clamp means also including a second clamp part disengageably mounted on said first clamp part and movable relative thereto to clamp a support shaft received in said aperture in said clamp means, said second clamp part bearing against the side of said first frame member opposite said second frame member to retain said first and second frame members in assembly, said frame members being held in assembly by said clamp parts, removal of said second clamp part from said first clamp part permitting ready disassembly of said frame members from each other.

2. The sheet-feed tractor of claim 1 wherein said second clamp part is rotatable on said first clamp part and is axially removable from said first clamp part in at least one rotational position but is positively retained on said first clamp part in at least one other rotational position.

3. The sheet-feed tractor of claim 2 wherein said first clamp part has a generally cylindrical exterior surface and said second clamp part includes a ring portion receiving the generally cylindrical exterior surface of said first clamp part therewithin, one of the interior surface of said ring portion and said generally cylindrical exterior surface of said first clamp part providing a radially extending tab and the other providing an engagement surface and an axial slot, said engagement surface engaging said tab throughout a first range of rotational positions of said second clamp part to prevent axial removal of said second clamp part from said first clamp part, said slot being aligned with said tab in at least one second rotational position of said second clamp part to permit axial removal of said second clamp part from said first clamp part and thereby disassembly of said frame members.

4. The sheet-feed tractor of claim 3 further comprising a cover member disengageably and pivotably mounted on said tractor frame for pivoting between an open position and a closed position, said cover member having a paper-engagement surface adapted for maintaining paper in engagement with said belt when said cover member is in said closed position thereof, said cover member further having a stop surface for preventing rotation of said second clamp part into said second rotational position thereof, said cover member thereby preventing disassembly of said tractor while said cover member is mounted on said frame, removal of said cover member permitting said second clamp part to assume said second rotational position for axial removal thereof and disassembly of said frame members.

5. The sheet-feed tractor of claim 2 further comprising a cover member disengageably and pivotably mounted on said tractor frame for pivoting between an open position and a closed position, said cover member having a paper-engagement surface adapted for maintaining paper in engagement with said belt when said cover member is in said closed position thereof, said cover member further having a stop surface for preventing rotation of said second clamp part into said second rotational position thereof, said cover member thereby preventing disassembly of said tractor while said cover member is mounted on said frame, removal of said cover member permitting said second clamp part to assume said second rotational position for axial removal thereof and disassembly of said frame members.

6. The sheet-feed tractor of claim 5 wherein said cover member is snap fit on said frame.

7. The sheet-feed tractor of claim 5 wherein said second clamp part includes a radially extending lever portion and said stop surface on said cover member engages said lever portion.

8. The sheet-feed tractor of claim 1 wherein said first clamp part and said second frame member are integrally molded as a single piece.

9. The sheet-feed tractor of claim 8 wherein said first clamp part has a generally cylindrical outer surface and said second clamp part includes a ring portion receiving the generally cylindrical exterior surface of said first clamp part therewithin, one of the interior surface of said ring portion and said generally cylindrical exterior surface of said first clamp portion providing a radially extending tab and the other providing an engagement surface and an axial slot, said engagement surface engaging said tab throughout a first range of rotational positions of said second clamp part to prevent axial removal of said second clamp part from said first clamp part, said slot being aligned with said tab in at least one second rotational position of said second clamp part to permit axial removal of said second clamp part from said first clamp part and thereby disassembly of said frame members.

10. A sheet-feed tractor adapted to be slidably mounted on spaced apart and substantially parallel extending elongated support and drive shafts comprising:

a. a first frame member;

b. a drive sprocket rotatably mounted on said first frame member for rotation about the axis of said drive sprocket and having an aperture therethrough adapted to receive the drive shaft for sliding therealong and for driving thereby upon rotation of the drive shaft about its longitudinal axis;

c. an endless belt disposed about said first frame member in engagement with said drive sprocket to be driven thereby upon driving movement of said sprocket by the drive shaft, said drive belt including sheet engagement teeth adapted to engage in the perforations of sheet material perforated adjacent the side margins thereof for advancement thereof upon driving of said drive belt by said sprocket;

d. a second frame member slidably mounted on said first frame member for sliding of said second frame member in a direction perpendicular to the rotational axis of said sprocket, said sprocket and said endless belt being disposed between said first and second frame members; and e. clamp means on said second frame member for sliding movement therewith relative to said first frame member, said clamp means having an aperture therethrough adapted to receive the support shaft therein and to clamp it in fixed position relative to said second frame member, variation in the spacing between the drive and support shafts while the support shaft is clamped to said second frame member thereby being accommodated by sliding of said second frame member relative to said first frame member.

11. The sheet-feed tractor of claim 10 wherein said clamp means includes at least a first clamp part and a second clamp part mounted on said first clamp part for movement relative thereto to clamp the support shaft therein.

12. The sheet-feed tractor of claim 11 wherein:

a. said first frame member has a support-shaft opening therein;

b. said first clamp part is disposed on said second frame member and extends through said support-shaft opening in said first frame member to the side of the said first frame member opposite that on which said second frame member is disposed; and c. said second clamp part is disengageably mounted on said first clamp part, said second clamp part bearing against the side of said first frame member opposite said second frame member to retain said first and second frame members in assembly, said frame members being held in assembly by said clamp parts, removal of said second clamp part from said first clamp part permitting ready disassembly of said frame members from each other.

13. The sheet-feed tractor of claim 12 wherein said second clamp part is rotatable on said first clamp part and is axially removable from said first clamp part in at least one rotational position but is positively retained on said first clamp part in at least one other rotational position.

14. The sheet-feed tractor of claim 13 wherein said first clamp part has a generally cylindrical exterior surface and said second clamp part includes a ring portion receiving the generally cylindrical exterior surface of said first clamp part therewithin, one of the interior surface of said ring portion and said generally cylindrical exterior surface of said first clamp part providing a radially extending tab and the other providing an engagement surface and an axial slot, said engagement surface engaging said tab throughout a first range of rotational positions of said second clamp part to prevent axial removal of said second clamp part from said first clamp part, said slot being aligned with said tab in at least one second rotational position of said second clamp part to permit axial removal of said second clamp part from said first clamp part and thereby disassembly of said frame members.

15. The sheet-feed tractor of claim 14 further comprising a cover member disengageably and pivotably mounted on said tractor frame for pivoting between an open position and a closed position, said cover member having a paper-engagement surface adapted for maintaining paper in engagement with said belt when said cover member is in said closed position thereof, said cover member further having a stop surface for preventing rotation of said second clamp part into said second rotational position thereof, said cover member thereby preventing disassembly of said tractor while said cover member is mounted on said frame, removal of said cover permitting said second clamp part to assume said second rotational position for axial removal thereof and disassembly of said frame members.

16. The sheet-feed tractor of claim 13 further comprising a cover member disengageably and pivotably mounted on said tractor frame for pivoting between an open position and a closed position, said cover member having a paper-engagement surface adapted for maintaining paper in engagement with said belt when said cover member is in said closed position thereof, said cover member further having a stop surface for preventing rotation of said second clamp part into said second rotational position thereof, said cover member thereby preventing disassembly of said tractor while said cover member is mounted on said frame, removal of said cover permitting said second clamp part to assume said second rotational position for axial removal thereof and disassembly of said frame members.

17. The sheet-feed tractor of claim 16 wherein said cover member is snap fit on said frame.

18. The sheet-feed tractor of claim 16 wherein said second clamp part includes a radially extending lever portion and said stop surface on said cover member engages said lever portion.

19. The sheet-feed tractor of claim 10 wherein:

a. said first frame member has a support-shaft opening therein;

b. said clamp means includes a first clamp part on said second frame member and extending through said support-shaft opening in said first frame member to the side of said first frame member opposite that on which said second frame member is disposed, said clamp means also including a second clamp part disengageably mounted on said first clamp part and moveable relative thereto to clamp a support shaft received in said aperture in said clamp means, said second clamp part bearing against the side of said first frame member opposite said second frame member to retain said first and second frame members in assembly, said frame members being held in assembly by said clamp parts, removal of said second clamp part from said first clamp part permitting ready disassembly of said frame members from each other.

20. The sheet-feed tractor of claim 19 wherein said second clamp part is rotatable on said first clamp part and is axially removable from said first clamp part in at least one rotational position but is positively retained on said first clamp part in at least one other rotational position.

21. The sheet-feed tractor of claim 20 wherein said first clamp part has a generally cylindrical exterior surface and said second clamp part includes a ring portion receiving the generally cylindrical exterior surface of said first clamp part therewithin, one of the interior surface of said ring portion and said generally cylindrical exterior surface of said first clamp part providing a radially extending tab and the other providing an engagement surface and an axial slot, said engagement surface engaging said tab throughout a first range of rotational positions of said second clamp part to prevent axial removal of said second clamp part from said first clamp part, said slot being aligned with said tab in at least one second rotational position of said second clamp part to permit axial removal of said second clamp part from said first clamp part and thereby disassembly of said frame members.

22. The sheet-feed tractor of claim 21 further comprising a cover member disengageably and pivotably mounted on said tractor frame for pivoting between an open position and a closed position, said cover member having a paper-engagement surface adapted for maintaining paper in engagement with said belt when said cover member is in said closed position thereof, said cover member further having a stop surface for preventing rotation of said second clamp part into said second rotational position thereof, said cover member thereby preventing disassembly of said tractor while said cover member is mounted on said frame, removal of said cover permitting said second clamp part to assume said second rotational position for axial removal thereof and disassembly of said frame members.

23. The sheet-feed tractor of claim 20 further comprising a cover member disengageably and pivotably mounted on said tractor frame for pivoting between an open position and a closed position, said cover member having a paper-engagement surface adapted for maintaining paper in engagement with said belt when said cover member is in said closed position thereof, said cover member further having a stop surface for preventing rotation of said second clamp part into said second rotational position thereof, said cover member thereby preventing disassembly of said tractor while said cover member is mounted on said frame, removal of said cover member permitting said second clamp part to assume said second rotational position for axial removal thereof and disassembly of said frame members.

24. The sheet-feed tractor of claim 23 wherein said cover member is snap fit on said frame.

25. The sheet-feed tractor of claim 23 wherein said second clamp part includes a radially extending lever portion and said stop surface on said cover member engages said lever portion.

26. A sheet-feed tractor adapted to be slidably mounted on spaced apart and substantially parallel extending elongated support and drive shafts comprising:

a. a first frame member having a support-shaft opening therein;

b. a second frame member assembled on said first frame member to form a tractor frame therewith;

c. a drive sprocket mounted on said tractor frame for rotation about the axis of said drive sprocket and having an aperture therethrough adapted to receive the drive shaft for sliding therealong and for driving thereby upon rotation of the drive shaft about its longitudinal axis;

d. an endless belt disposed about said tractor frame in engagement with said drive sprocket to be driven thereby upon driving movement of said sprocket by the drive shaft, said drive belt including sheet engagement teeth adapted to engage in the perforations of sheet material perforated against the side margins thereof for advancement thereof upon driving of said belt by said sprocket;

e. clamp means, having an aperture therethrough adapted to receive the support shaft therein, for clamping the support shaft received therein, said clamp means including a first clamp part on said second frame member and extending through said support-shaft opening in said first frame member to the side of said first frame member opposite that on which said second frame member is disposed, said first clamp part having a generally cylindrical outer surface, said clamp means also including a second clamp part disengageably mounted on said first clamp part and moveable relative thereto to clamp a support shaft received in said aperture in said clamp means, said second clamp part including a ring portion receiving the generally cylindrical exterior surface of said first clamp part therewithin, one of the interior surface of said ring portion and said generally cylindrical exterior surface of said first clamp part providing a radially extending tab and the other providing an engagement surface and an axial slot, said engagement surface engaging said tab throughout a first range of rotational positions of said second clamp part to cause said ring portion to bear against the side of said first frame member opposite said second frame member to retain said first and second frame members in assembly and prevent axial removal of said second clamp part from said first clamp part, said slot being aligned with said tab in at least one second rotational position of said second clamp part to permit axial removal of said second clamp part from said first clamp part, said second clamp part also including an extension portion extending from said ring portion to provide a second engagement surface adjacent an edge of said extension portion remote from said ring portion and spaced from said first engagement surface in a direction generally perpendicular to the axis of said support-shaft opening; and f. a post on said second frame member, said first frame member having a post aperture spaced from said support-shaft opening, said post extending from said second frame member through said post aperture in said first frame member to the side of said first frame member opposite that on which said second frame member is disposed and being positioned radially beyond said remote edge of said extension portion, said post including a second tab extending radially inward of said remote edge of said extension portion to engage said second engagement surface throughout said first range of rotational positions of said second clamp part to cause said extension portion to bear against said side of said first frame member opposite said second frame member to retain said first and second frame members in assembly and prevent axial removal of said second clamp part from said first clamp part, said second engagement surface clearing said second tab in said second rotational position of said second clamp part to permit axial removal of said second clamp part from said first clamp part, said frame members being held in assembly by said clamp parts, removal of said second clamp part from said first clamp part permitting ready disassembly of said frame members from each other.

* * * * *